United States Patent [19]

Bowyer

[11] 4,136,873

[45] Jan. 30, 1979

[54] TARGETS AND MATERIALS THEREFOR

[75] Inventor: William H. Bowyer, Farnham, England

[73] Assignee: Australasian Training Aids Pty. Ltd., Albury, Australia

[21] Appl. No.: 704,551

[22] Filed: Jul. 12, 1976

Related U.S. Application Data

[63] Continuation of Ser. No. 590,214, Jun. 25, 1975, abandoned.

[30] Foreign Application Priority Data

Jun. 28, 1974 [GB] United Kingdom ..... 28956/74

[51] Int. Cl.[2] ..... F41J 1/02

[52] U.S. Cl. ..... 273/102 B; 273/DIG. 4

[58] Field of Search ..... 273/DIG. 4, 102 R, 102 B, 273/102.2 S, 102.1 R, 102.2 A, 102, 102.1, 102.2; 260/42.46

[56] References Cited

U.S. PATENT DOCUMENTS

| | | | |
|---|---|---|---|
| 3,157,614 | 11/1964 | Fischer | 260/42.46 X |
| 3,409,301 | 11/1968 | Studen | 273/102 B |
| 3,516,670 | 6/1970 | D'Agnostino et al. | 273/DIG. 4 |
| 3,682,478 | 8/1972 | Knight | 273/102.5 X |

FOREIGN PATENT DOCUMENTS

| | | | |
|---|---|---|---|
| 1134422 | 11/1968 | United Kingdom | 273/DIG. 4 |

OTHER PUBLICATIONS

Van Nostrand's Scientific Encyclopedia; 1968; pp. 947, 1367, 1370.

The Society of Plastics Engineers; "Higher-Density Polyethylenes;" Oct., 1957; pp. 37, 38.

*Primary Examiner*—Vance Y. Hum

*Attorney, Agent, or Firm*—Donald D. Jeffery

[57] ABSTRACT

A target formed from a material comprising a mixture of polyethylene and talc. The inclusion of talc improves the properties of the target at temperatures ranging from in excess of 60° C down to minus 20° C or below.

8 Claims, 3 Drawing Figures

TARGETS AND MATERIALS THEREFOR

This is a continuation, of application Ser. No. 590,214, filed June 25, 1975, now abandoned.

FIELD OF THE INVENTION

This invention concerns targets formed of polyethylene materials. The invention has particular application in relation to targets of the kind used with troop etc., training equipment such as for example that described and claimed in U.S. Pat. No. 3,233,904 and 3,323,800.

DISCUSSION OF PRIOR ART.

It will be understood that many efforts have been made to find a material from which to create a target which has a reasonable life and which can satisfactorily operate over a wide range of ambient temperatures. Furthermore because equipment used with such targets very often incorporates automatic hit sensing apparatus it is also especially desirable to have a target which satisfactorily transmits shock waves to a sensor associated with the target when the target is hit by a projectile such as a bullet over such wide range of ambient temperatures.

It has been proposed to use polypropylene, polyethylene and ABS plastics material for the manufacture of targets but targets made of each of these materials have had serious disadvantages. Polypropylene, for example, is unsatisfactory at low temperatures - the target formed therewith disintegrating when hit by a projectile. Polyethylene on the other hand whilst being generally satisfactory at the low temperatures, where difficulties are encountered with polypropylene, is unsatisfactory in higher temperature ranges, the material tending readily to distort and further losing its rigidity with the result that it becomes an unsatisfactory material for transmitting reliably shock waves stemming from a projectile hitting the target. ABS plastics materials tend to be satisfactory at higher temperatures but in the medium to low range of temperatures the targets formed of this material either disintegrate or large fragments break out from the target when it is hit by a projectile.

Ideally a target material is required from which targets may be produced relatively economically and which will not suffer from these aforementioned disadvantages when hit with 0.223 inch (5.65 mm) high velocity ammunition at a temperature as high as plus 60° C. or when hit by 9 mm pistol ammunition at a temperature as low as minus 20° C.

Such a wide range is desirable because targets and target apparatus are used for training over very widely differing climatic conditions, being used either in subzero conditions in Arctic locations and similarly at high ambient temperatures such as in desert areas.

OBJECT OF THE INVENTION

One object of this invention is to provide a material which will operate more satisfactorily especially in relation to transmitting shock waves within the above specifically mentioned temperature range. Other objects and features will be apparent from further reading of the specification.

STATEMENT OF INVENTION

According to this invention there is provided a target formed from a material comprising a mixture of polyethylene and talc filler, with the target being formed with at least one rib or groove to enhance the rigidity thereof.

GENERAL DISCUSSION

It should be noted that either high or low density polyethylene may be utilized, a low density polyethylene tending to be more satisfactory in the lower temperature range and less satisfactory in the high temperature range than high density polyethylene.

The effect of providing a filler, such as talc, is to modify the characteristics of the polyethylene at various temperatures and thus by adjusting the proportion of talc in relation to polyethylene and also by selecting high or low density polyethylene a wide range of compositions can be provided which can be used to bridge temperature ranges within an overall range in excess of plus 60° C. down to minus 20° C.

In practice the inclusion of talc tends to raise the temperature at which the material will disintegrate under impact from a projectile such as a bullet but not beyond an acceptable level. The inclusion of talc on the other hand lessens the likelihood of distortion and substantially improves shock wave transference characteristics in the higher end of the temperature range.

Thus, said target may advantageously be formed from high density polyethylene and the talc content, as a percentage by weight, is about 10 percent or less.

It should be noted that it is foreseen that a satisfactory target may be formed by the use of low density polyethylene having a talc content by weight of above about 10 percent, for example, to about 15 percent.

To improve the shock wave transference characteristics of the target to assist sensing reliably "hits", the target may be provided with ribs and/or with a generally roughened surface configuration created by the provision of a multiplicity of small grooves or ribs.

BRIEF DESCRIPTION OF THE DRAWINGS

In order that the invention may be more readily understood one embodiment of target in accordance with this invention will now be described by way of example and with reference to the accompanying drawings in which.

DETAILED DESCRIPTION OF THE PREFERRED EMBODIMENTS

Figure 1:
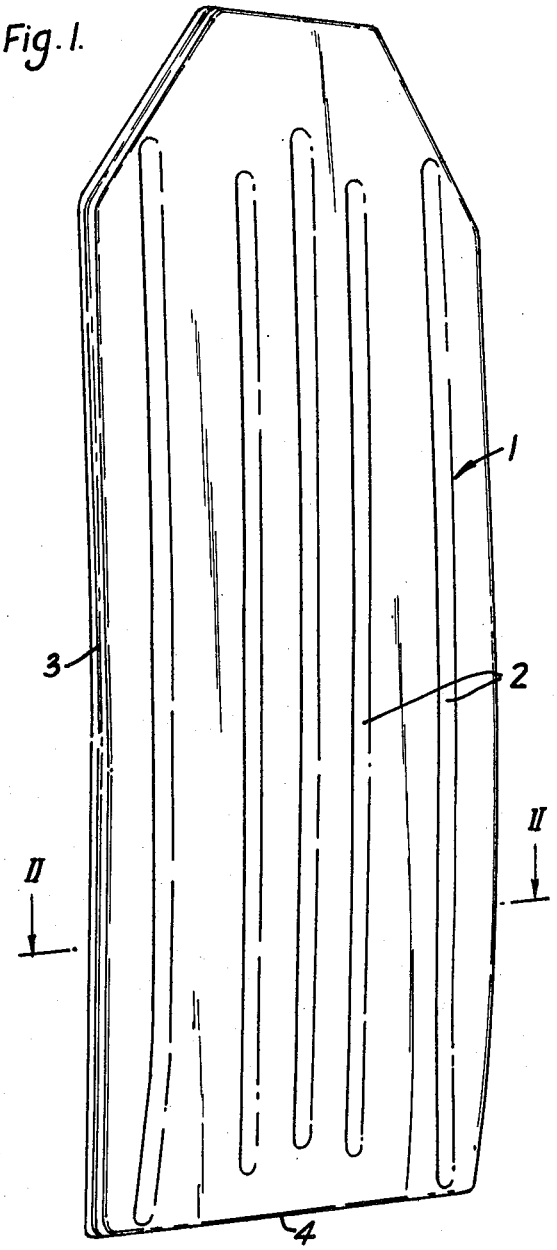
FIG. 1 is a front perspective view of a simple target in accordance with this invention.
Figure 2:
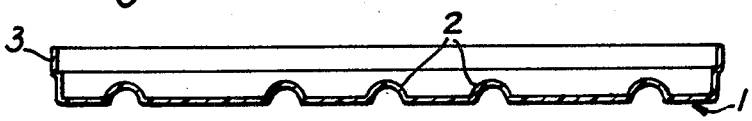
FIG. 2 is a sectional view on the line 11—11 through the target of FIG. 1.
Figure 3:
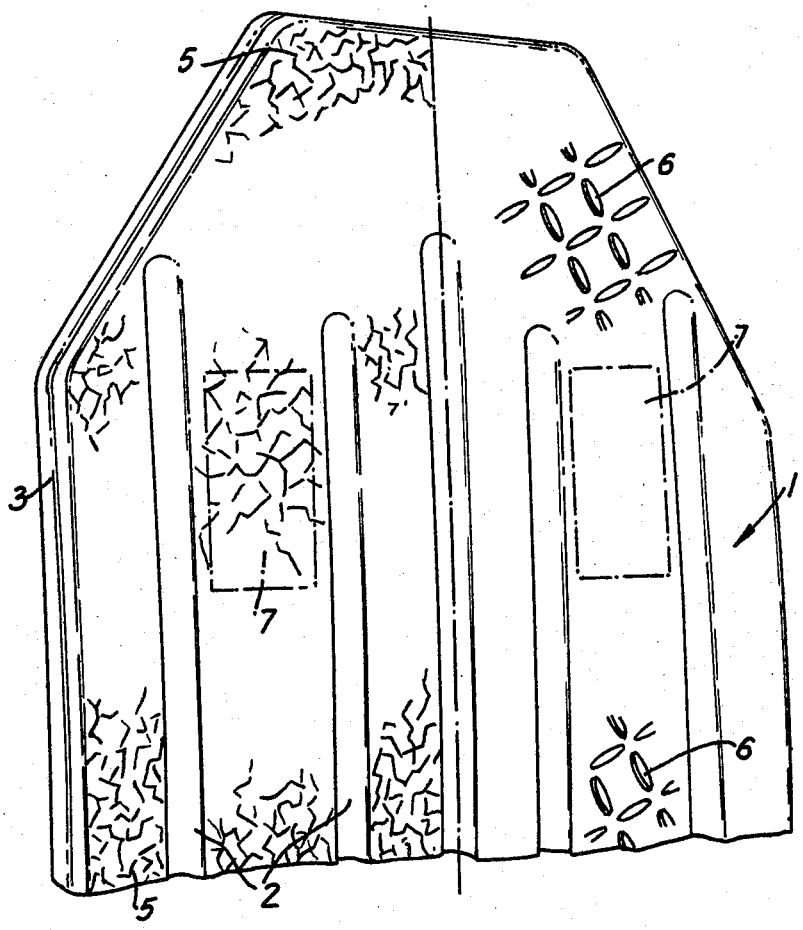
FIG. 3 is an enlarged fragmentary front perspective view of a target similar to FIG. 1 but showing alternative or additional forms of surface configurations which may be applied to the target to alter and improve the stiffness characteristics of the target which improves the shock wave transference characteristics which in turn assists in sensing reliably "hits" on the target.

A basic target 1 comprises a moulding of high density polyethylene having a filler of talc of 10 percent by weight. The moulding is approximately 3 mm thick, 52 inches high and approximately 18 inches wide, and is provided with the plurality of substantially parallel vertical grooves 2 in the front face and a peripheral rearwardly extending flange 3, such grooves 2 and flange 3 being provided to produce appropriate rigidity. The target 1 is designed to operate over a wide range and is suitable for 9 mm pistol shooting down to temperatures of minus 20° C. and yet is also suitable for 0.223 inch (5.65 mm) high velocity ammunition from rifle fire at plus 65° C.

Because it is desirable to minimise the volume of material used in creating the target for cost reasons, the target 1 is made as thinly as feasible, the grooves 2 or the like being provided to produce a sufficiently rigid structure to enable the target to be used with target training apparatus which incorporate hit sensors which sense shock waves transmitted by the target from the point of impact of the bullet. To ensure that the target 1 is sufficiently stiff to transmit satisfactory shock waves from all areas of the target 1 to the sensor (which is normally located at the base 4 of the target) said ribs 2 may be increased or located in any desired direction. Furthermore the surface of the target may be moulded so as to have a generally "crazed" appearance formed up of a plurality of fine grooves or ribs as diagrammatically shown at 5. Alternatively other configurations of this type may be provided and a typical example of a more formal surface configuration is shown at 6 which comprises a plurality of short ribs or grooves having a slightly elliptical form. In addition to these aids for rigidity and shock transmission the thickness of certain areas of the target may be increased. Two small areas 7 towards the upper portion to each side of the center line of the target tend to be less able to transmit shock waves and thus areas of the target in these portions are particularly suitable for such increased thickness.

Tests carried out on targets of the type described hereinbefore indicate that such targets perform satisfactorily with 0.223 inch (0.565 cm) ammunition at temperatures as high as 67° C. and temperatures as low as minus 40° C. It is to be noted that such 0.223 inch ammunition is one of the hardest types of ammunition to detect.

I claim:

1. A target formed from a material comprising a mixture of high density polyethylene and a filler in the form of talc, the talc content, as a percentage by weight, being 10 percent or less, in amounts sufficient so that said target is capable of transmitting shock waves for hit detection in temperatures ranging from −20° C. to +60° C. for ammunition ranging from 5.65 mm to 9 mm.

2. A target according to claim 1, wherein said target is provided with at least one rib to rigidify the same.

3. The target according to claim 1, wherein said target is provided with a generally roughened surface configuration created by the provision of a multiplicity of small ribs.

4. The target according to claim 1, wherein particular areas of the target have an increased thickness.

5. A target formed from a material comprising a mixture of low density polyethylene and a filler in the form of talc, the talc content, as a percentage by weight, being between 10 and 15 percent, said target being capable of transmitting shock waves for hit detection in temperatures ranging from −20° C. to +60° C. for ammunition ranging from 5.65 mm. to 9 mm.

6. A target according to claim 5, wherein said target is provided with at least one rib to rigidify the same.

7. The target according to claim 5, wherein said target is provided with a generally roughened surface configuration created by the provision of a multiplicity of small ribs.

8. The target according to claim 5, wherein particular areas of the target have an increased thickness.

* * * * *